United States Patent [19]

Nakahira

[11] 3,977,660

[45] Aug. 31, 1976

[54] BLAST-FURNACE TUYERE HAVING EXCELLENT THERMAL SHOCK RESISTANCE AND HIGH DURABILITY

[75] Inventor: Hiroshi Nakahira, Nishinomiya, Japan

[73] Assignee: Toyo Calorizing Ind. Co., Ltd., Kobe, Japan

[22] Filed: Feb. 28, 1974

[21] Appl. No.: 447,003

[52] U.S. Cl. ..... 266/265; 427/34; 427/405; 427/419; 427/423; 427/427; 29/195; 29/199

[51] Int. Cl.[2] ..... C21B 7/16

[58] Field of Search ..... 117/71 M, 93.1 PF, 105.2; 110/182.5; 29/194, 197, 195 M, 157 C, 199; 427/34, 403, 404, 405, 419, 423, 427; 428/457, 472; 266/41, 265

[56] References Cited

UNITED STATES PATENTS

| | | | |
|---|---|---|---|
| 3,069,760 | 12/1962 | Schultz | 29/195 |
| 3,427,698 | 2/1969 | Guzewicz | 29/157 |
| 3,719,519 | 3/1973 | Perugini | 117/71 M |

FOREIGN PATENTS OR APPLICATIONS

| | | | |
|---|---|---|---|
| 673,038 | 10/1963 | Canada | 117/71 M |

*Primary Examiner*—Cameron K. Weiffenbach
*Attorney, Agent, or Firm*—Young & Thompson

[57] ABSTRACT

A blast-furnace tuyere having excellent thermal-shock resistance and high durability consists of a tuyere substrate composed of copper or copper alloy, a nickel or cobalt base self-fluxing alloy metallized layer sprayed on the said substrate, a zirconia or alumina base cermet layer sprayed on the said alloy metallized layer and a zirconia or alumina ceramic coating layer sprayed on the said cermet layer.

11 Claims, 3 Drawing Figures

BLAST-FURNACE TUYRE HAVING EXCELLENT THERMAL SHOCK RESISTANCE AND HIGH DURABILITY

BACKGROUND OF THE INVENTION

1. Field of the Invention:

The present invention relates to a blast-furnace tuyere having excellent thermal-shock resistance and high durability.

2. Description of the Prior Art:

In general, the tuyere composed of copper or copper alloy as a substrate is exclusively used in a water-cooling fashion for blowing hot air into a blast-furnace. However, since the end portion of the tuyere projects into the blast-furnace and is exposed to a severe environment in the furnace, it is particularly liable to be damaged due to the overheating by contacting with molten iron or slag. Consequently, an explosion accident may be caused by leaking out water used for cooling the tuyere and also a heat loss and a considerable reduction of tapping amount are brought about by lowering the temperature inside the furnace. Furthermore, the exchange of the damaged tuyere is a dangerous operation and it requires a great amount of labor and time. In a recent large-scale blast-furnace, the temperature of hot air blowing into the furnace is above 1,300°C and further blowing of heavy oil or oxygen and high-handed operation are adopted, so that the condition of use of the tuyere becomes more severe. Therefore, it becomes more important to develop technics for preventing the damages of tuyeres per a blast-furnace as the blast-furnace becomes large-size.

Heretofore, various attempts have been made to the use of the tuyere obtained by applying a metal coating 2 to a copper substrate 1 of the tuyere body and applying a ceramic coating 3 to the metal coating 2 as shown in FIG. 1. As a successful example of these attempts, there is known a tuyere composed of a copper substrate, a metal coating consisting of 60–62% of nickel, 12–15% of chromium and the remainder of iron, manganese and carbon, and a ceramic coating of molten alumina ($Al_2O_3$) wherein the thickness of the metal coating is 0.0127–0.508 mm, preferably 0.0508–0.1778 mm and that of the ceramic coating is 0.0254–1.016 mm, preferably 0.127–0.381 mm. In this example, the metal suitable for the use as the metal coating includes austenitic steels of AISI standard 301, 302, 302B, 303, 304, 308, 309, 310, 316, 321, 347, etc., chromium steels of AISI standard 403, 405, 406, 410, 414, 420, 430, 431, 440A, 440B, 440C, 442, 443, 446, 501, 502, etc., and pure nickel. However, these metals have not a chemical affinity to the copper substrate but are mechanically bonded to the substrate, so that they are apt to peel off from the substrate and are not particularly suitable.

Further, in order to apply the ceramic coating to said metal coating, it is known to use ceramics such as alumina, beryllium oxide, calcium oxide, cerium oxide, chromium oxide, chromite, magnesia, silica, strontium oxide, zirconia, zirconium oxide silicate and the like.

Moreover, in the prior art, the expansion coefficient of the metal coating (e.g., expansion coefficient of the above mentioned alloy: about $14–15\times10^{-6}$) is defined to be intermediate between expansion coefficients of the copper substrate (expansion coefficient of pure copper: $16.5\times10^{-6}$) and the ceramic coating (expansion coefficient of the ceramic: about $7.5–9.0\times10^{-6}$).

However, the difference of expansion coefficient between the metal coating and the ceramic coating is considerably large in practice. Therefore, in the practical use of such a tuyere, the ceramic coating peels off from the metal coating at the deposited surface, so that the operation time of the said tuyere is not substantially prolonged as compared with that of a tuyere composed only of copper substrate.

SUMMARY OF THE INVENTION

It is an object of the present invention to solve the above described disadvantages of conventional protecting means for tuyeres and to considerably prolong the operation time of the tuyere.

It is another object of the present invention to provide a blast-furnace having excellent thermal-shock resistance and high durability as compared with the conventional tuyeres.

The present invention lies in a blast-furnace tuyere having excellent thermal-shock resistance and high durability which consists of a tuyere substrate composed of copper or copper alloy, a nickel or cobalt base self-fluxing alloy metallized layer sprayed on the surface of said substrate, a zirconia or alumina base cermet layer sprayed on the surface of said alloy metallized layer and a zirconia or alumina ceramic coating layer sprayed on the surface of said cermet layer.

DETAILED DESCRIPTION OF THE INVENTION

According to the present invention, the embodiment of manufacturing the tuyere is illustrated as follows.

1. The surface of the tuyere substrate composed mainly of copper is previously roughened by any mechanical means and then blasted with grits of steel or alumina so as to make further roughening and cleaning the surface thereof.

2. A nickel base self-fluxing alloy consisting essentially of 65–90 wt.% of nickel, 10–35 wt.% of chromium, 1.5–4.5 wt.% of silicon and 1.5–4.5 wt.% of boron or a cobalt base self-fluxing alloy consisting essentially of 40–60 wt.% of cobalt, 19–21 wt.% of chromium, 1.5–4.5 wt.% of silicon and 1.5–4.5 wt.% of boron and containing a small amount of nickel and tungsten is sprayed on the surface of the tuyere substrate at an appropriate thickness by means of a spraying device using plasma jet or oxy-acetyleneflame as a heat source to form an alloy metallized layer.

3. The following three cermet powders are sprayed on the surface of the resulting alloy metallized layer at an appropriate thickness by means of a spraying device using plasma jet or oxy-acetylene flame as a heat source to form a cermet layer.

a. Zirconia or alumina base cermet powder consisting of a mixture of zirconia or alumina having a purity of more than 90% and nickel-chromium alloy consisting mainly of 65–90 wt.% of nickel and 10–35 wt.% of chromium in a mixing ratio of 30:70 – 70:30.

b. Zirconia or alumina base cermet powder consisting of a mixture of zirconia or alumina having a purity of more than 90% and the nickel or cobalt base self-fluxing alloy described in the above item (2) in a mixing ratio of 30:70 – 70:30.

c. Zirconia or alumina base cermet powder consisting of a mixture of zirconia or alumina having a plurality of more than 90% and nickel-aluminum alloy consisting mainly of 80–95 wt.% of nickel and 20–5 wt.% of aluminum in mixing ratio of 30:70 – 70:30.

4. Zirconia or alumina having a purity of more than 90% is sprayed on the surface of the resulting cermet layer at an appropriate thickness by means of a spraying device using plasma jet or oxy-acetylene flame as a heat source to form a top ceramic coating layer.

A combination of materials used for each step of the above described procedure may be optionally selected from the following Table.

| Alloy metallized layer | Cermet layer | Top ceramic coating layer |
|---|---|---|
| Ni base self-fluxing alloy | (Ni base self-fluxing alloy + zirconia) | zirconia |
| " | (Ni base self-fluxing alloy + alumina) | alumina |
| " | (Ni-Cr alloy + zirconia) | zirconia |
| " | (Ni-Cr alloy + alumina) | alumina |
| " | (Ni-Al alloy + alumina) | alumina |
| Co base self-fluxing alloy | (Co base self-fluxing alloy + zirconia) | zirconia |
| " | (Co base self-fluxing alloy + alumina) | alumina |
| " | (Ni-Al alloy + alumina) | alumina |

Figure 2:
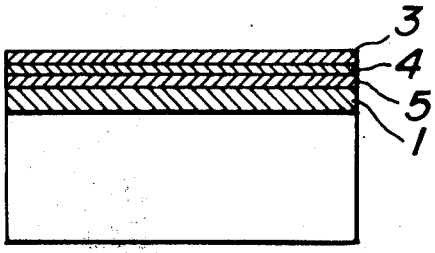
FIG. 2 is a fragmentary cross-sectional view of an embodiment of the tuyere according to the present invention.

The structure of the tuyere according to the present invention is shown in FIG. 2, wherein 1 represents a copper substrate, 5 a self-fluxing alloy metallized layer, 4 a cermet layer and 3 represents a ceramic coating layer.

An aspect of the present invention lies in that self-fluxing alloys, wherein silicon and boron are added to nickel or cobalt base heat resisting super alloy as mentioned above to give a self-fluxing property to the alloy, are used as an alloy to be sprayed on the copper substrate.

When the heat resisting alloy containing no silicon and boron according to the prior art is sprayed on the copper substrate, metal oxides are produced in an alloy deposited surface and a resulting alloy metallized layer during the spraying process, so that properties of the alloy metallized layer itself are deteriorated. Further, the adhesion of the alloy to the copper is merely a mechanical bonding, so that the bonding strength is weak and the alloy is apt to peel off from the copper substrate.

On the contrary, when the self-fluxing alloy containing silicon and boron according to the present invention is sprayed on the copper substrate, the presence of metal oxides is less in the alloy deposited surface and the resulting alloy metallized layer and also the alloy metallized layer has a high bonding strength to the substrate and is hardly peeled off. This fact will be understood from the following reasons. Since silicon and boron are metals having a strong reducing property at an elevated temperature, if the copper and the component constituting mainly the self-fluxing alloy are oxidized to form oxides, these resulting oxides are immediately reduced by silicon and boron to the metals and at the same time silicon and boron are oxidized, respectively. Both the latter oxides form an eutectic oxide having a melting point lower than that of each oxide itself, i.e., a flux and elute on the surface of the alloy metallized layer, so that the presence of metal oxides is substantially very little in the alloy deposited surface and the alloy metallized layer. In other words, when either silicon or boron is used, this element contributes to the reduction of the metal oxides, but the resulting silicon or boron oxide has a higher melting point and does not elute as a flux on the surface of the alloy metallized layer, so that such an oxide is present in the alloy metallized layer and the alloy deposited surface and further properties of the alloy metallized layer and the alloy deposited surface are deteriorated.

The reason why the bonding of the copper substrate to the self-fluxing alloy containing silicon and boron is superior to that of the copper substrate to the heat resisting alloy containing no silicon and boron is considered to be due to the fact that the melting point of the self-fluxing alloy is low and its range is from 1,020° to 1,100°C and further silicon and boron can easily form intermetallic compounds not only with nickel, chromium, cobalt, etc. constituting the heat resisting alloy but also with the copper substrate and the bonding between both the intermetallic compounds is fairly superior to that of the copper to the heat resisting alloy. Namely, the presence of silicon and boron is considered to enhance the bonding of the copper substrate to the heat resisting alloy.

The amounts of silicon and boron to be added are preferably 1.5 to 4.5% by weight, respectively. When the amount is less than 1.5%, the metal oxides increases in the alloy metallized layer and the alloy deposited surface, while the formation of intermetallic compounds with silicon and boron decreases and further the melting point of the metallized alloy is high, so that the mechanical bonding is insufficient and the metallized alloy is apt to peel off from the copper substrate. Further, when the amount is more than 4.5%, properties of the alloy metallized layer itself are deteriorated and the melting point fairly lowers so that the heat resistance is poor.

Another aspect of the present invention is to form a cermet layer on the self-fluxing alloy metallized layer. Namely, according to the present invention, zirconia or alumina as a heat resisting substance is mixed with any one of nickel base self-fluxing alloy, cobalt base self-fluxing alloy, nickel-chromium alloy, nickel-aluminum alloy and the like as a binder and the resulting mixture is sprayed on the self-fluxing alloy metallized layer as an appropriate thickness by means of a spraying device using plasma jet or oxy-acetylene flame as a heat source to form a cermet layer.

In the prior art, a ceramic coating is formed on a mere heat resisting alloy different from the self-fluxing heat resisting alloy as mentioned above, but it is not suitable for the practical use. Furthermore, a metal having an intermediate expansion coefficient between the expansion coefficients of the copper substrate and the ceramic coating layer is sprayed on the copper substrate to form a metal coating layer, but the difference of expansion coefficient between the metal coating layer (about $14.0\times10^{-6}$) and the ceramic coating layer ($7.7–8.8\times10^{-6}$) is very large, so that the bonding surface between both the coating layers is considerably deviated and it is difficult to avoid the peeling off of the ceramic coating layer from the metal coating layer.

According to the present invention, however, a mixture of zirconia or alumina as a heat resisting ceramic substance and one of the above mentioned alloys as a binder is used in a mixing ratio of 30:70 to 70:30. This binder can strongly bind not only with the self-fluxing alloy metallized layer but also with the heat resisting ceramic substance. Therefore, the resulting cermet layer has excellent mechanical strength, antioxidation and thermal-shock resistance even at a temperature of more than 1,000°C.

According to the present invention, a ceramic coating layer is formed as a top coating on the cermet layer. The thermal expansion coefficient of the cermet layer is smaller than that of the self-fluxing alloy metallized layer and larger than that of the ceramic coating layer. Further, the thermal expansion coefficient in each layer gradually changes as compared with that of the prior art having only the metal coating and ceramic coating layers, so that the peeling off of the ceramic coating layer due to the difference of thermal expansion coefficient between the cermet layer and the ceramic coating layer can be particularly reduced considerably. This is the other aspect of the present invention. The ceramic to be used for the ceramic coating layer is desirable to be the same quality as the heat resisting substance in the cermet layer, so that the zirconia or alumina as described above is mainly used.

The thickness of the self-fluxing alloy metallized layer is 50–150 $\mu$, preferably 70–130 $\mu$, and more particularly about 100 $\mu$. The cermet layer has the same thickness as in the self-fluxing alloy metallized layer, and particularly the thickness of about 100 $\mu$ is most preferable. The thickness of the ceramic coating layer is preferably 100–300 $\mu$.

The reason why the thickness of the self-fluxing alloy metallized layer, cermet layer and ceramic coating layer are limited to the above mentioned ranges, respectively, is as follows.

Namely, the self-fluxing alloy metallized layer and the cermet layer are coatings for improving an adherence to the subsequent layer, so that they may become thinner. However, if the thickness is considerably thin, they are not available to resistant for thermal-shock. Therefore, they must have a thickness sufficient to mitigate the thermal-shock. From these reasons, the thickness of said layers is necessary to be at least 50 $\mu$ and at most 150 $\mu$.

The ceramic coating layer is required heat resistance, corrosion resistance and antioxidation, so that the thickness of this layer is necessary to be at least 100 $\mu$ so as to satisfy these requirements. However, when the total thickness of said three layers is considerably large, the peeling off from the copper substrate is apt to be caused, so that the said total thickness should be not more than 600 $\mu$ in any cases from the viewpoint of the safety and hence the thickness of the ceramic coating layer is necessary to be less than 300 $\mu$.

In all spraying steps, it is more desirable to effect a plasma jet process from the following two reasons.

1. In the plasma jet process, an inert gas such as nitrogen, argon, helium and the like is used as an operating gas, so that the spraying materials and the surface of the copper substrate are not oxidized during the spraying.

2. The temperature of the heat source in the plasma jet device is extremely higher than that in a powder spraying device using an oxy-acetylene flame (the former is usually 8,500°–10,000°C, while the latter is 3,000°C at maximum), so that the spraying materials are completely melted. And also, the spraying speeed is higher in the plasma jet process (approximately sound speed), so that kinetic energy of the sprayed molten particles becomes larger. Thereby, not only the bounding strength of the coating to the surface of the substrate but also the bonding force between particles forming the coating considerably increases as compared with the case of the oxy-acetylene process. Furthermore, the porosity can be restrained to a few %.

The following example is given in illustration of this invention and is not intended as limitations thereof.

EXAMPLE

A copper substrate usually used for tuyere was subjected to various coating treatments and a thermal-shock test was carried out with respect to the resulting tuyere. Thermal-shock test: The tuyere was heated to about 800°C and then quenched (i.e., cooled with water) and this procedure was repeated.

Figure 1:
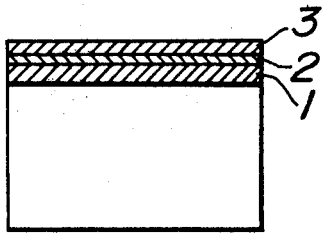
FIG 1 PRIOR ART
FIG. 1 is a fragmentary cross-sectional view of a conventional tuyere used for blast-furnace.

Test results:

In the conventional tuyere as shown in FIG. 1, partial peeling was caused by only two times of the above test procedure, in which the substrate 1 was copper, the metal coating layer 2 was nickel aluminide, austenitic steel or chromium steel and the ceramic coating layer 3 was alumina.

On the other hand, in the following four tuyeres of the present invention as shown in FIG. 2, the peeling was not caused by the test procedure at 8 times repeatedly, so that the test was stopped at 8 times.

Tuyere A:

This tuyere consisted of the copper substrate, the nickel base self-fluxing alloy metallized layer, the alumina base cermet layer containing nickel base self-fluxing alloy, and the alumina coating layer.

Tuyere B:

This tuyere consisted of the copper substrate, the nickel base self-fluxing alloy metallized layer, the zirconia base cermet layer containing nickel base self-fluxing alloy, and the zirconia coating layer.

Tuyere C:

This tuyere consisted of the copper substrate, the cobalt base self-fluxing alloy metallized layer, the alumina base cermet layer containing cobalt base self-fluxing alloy, and the alumina coating layer.

Tuyere D:

This tuyere consisted of the copper substrate, the cobalt base self-fluxing alloy metallized layer, the zirconia base cermet layer containing cobalt base self-fluxing alloy, and the zirconia coating layer.

The blast-furnace tuyere according to the present invention is particularly effective at a higher hot air temperature of more than 1,300°C. In fact, the average operation time of the conventional non-coated copper tuyere is about 4 months, while that of the tuyere according to the present invention is more than 6 months. From this fact, the tuyere of the present invention considerably contributes to an improvement of productivity in blast-furnace operation.

What is claimed is:

1. A blast-furnace tuyere having excellent thermal shock resistance and high durability which consists essentially of a tuyere substrate composed of a member selected from the group consisting of copper and copper alloy; a self-fluxing alloy metallized layer sprayed on the surface of said substrate, said alloy being selected from the group consisting of nickel-base alloy consisting essentially of 65–90% nickel, 10–35% chromium, 1.5–4.5% silicon and 1.5–4.5% boron, and a cobalt-base alloy consisting essentially of 40–60% cobalt, 19–21% chromium, 1.5–4.5% silicon, 1.5–4.5% boron and a small amount of nickel and tungsten; a cermet layer sprayed on the surface of said alloy metallized layer, said cermet being selected from the group consisting essentially of a mixture of zirconia or alumina, having a purity of more than 90%, with a nickel-chromium alloy consisting essentially of 65–90% nickel and 10–35% chromium, in a mixing ratio of 30:70–70:30, a mixture of zirconia or alumina, having a purity of more than 90%, with a nickel base alloy consisting essentially of 65–90% nickel, 10–35% chromium, 1.5–4.5% silicon and 1.5–4.5% boron, in a mixing ratio of 30:70–70:30, a cobalt-base alloy consisting essentially of 40–60% cobalt, 19–21% chromium, 1.5–4.5% silicon, 1.5–4.5% boron and a small amount of nickel and tungsten, in a mixing ratio of 30:70–70:30, and a mixture of zirconia or alumina, having a purity of more than 90%, with a nickel-aluminum alloy consisting essentially of 80–95% nickel and 20–5% aluminum, in a mixing ratio of 30:70–70:30; and a ceramic coating layer selected from the group consisting of zirconia and alumina sprayed on the surface of said cermet layer; all percentages being by weight.

2. A blast-furnace tuyere as claimed in claim 1 wherein zirconia or alumina having a purity of more than 90% is used as the ceramic coating layer.

3. A blast-furnace tuyere as claimed in claim 1 wherein the thickness of said zirconia or alumina ceramic coating layer is 100–300 $\mu$.

4. A blast-furnace tuyere as claimed in claim 1 wherein the thickness of said nickel or cobalt base self-fluxing alloy metallized layer is 50–150 $\mu$.

5. A blast-furnace tuyere as claimed in claim 4, wherein said thickness is 70–130 $\mu$.

6. A blast-furnace tuyere as claimed in claim 4, wherein said thickness is about 100 $\mu$.

7. A blast-furnace tuyere as claimed in claim 1 wherein the thickness of said zirconia or alumina base cermet layer is 50–150 $\mu$.

8. A blast-furnace tuyere as claimed in claim 7, wherein said thickness is 70–130 $\mu$.

9. A blast-furnace tuyere as claimed in claim 7, wherein said thickness is about 100 $\mu$.

10. A method of manufacturing a blast-furnace tuyere having excellent thermal shock resistance and high durability, which comprises roughening a surface of a tuyere substrate composed of a member selected from the group consisting of copper and copper alloy; spraying a self-fluxing alloy on the surface of said substrate by means of a spraying device using plasma jet or oxy-acetylene flame as a heat source to form a self-fluxing alloy metallized layer, said alloy being selected from the group consisting of nickel-base alloy consisting essentially of 65–90% nickel, 10–35% chromium, 1.5–4.5% silicon and 1.5–4.5% boron, and a cobalt-base alloy consisting essentially of 40–60% cobalt, 19–21% chromium, 1.5–4.5% silicon, 1.5–4.5% boron and a small amount of nickel and tungsten; spraying a cermet powder on said self-fluxing alloy metallized layer by means of a spraying device using plasma jet or oxy-acetylene flame as a heat source to form a cermet layer said cermet being selected from the group consisting essentially of a mixture of zirconia or alumina, having a purity of more than 90%, with a nickel-chromium alloy consisting essentially of 65–90% nickel and 10–35% chromium, in a mixing ratio of 30:70–70:30, a mixture of zirconia or alumina, having a purity of more than 90%, with a nickel base alloy consisting essentially of 65–90% nickel, 10–35% chromium, 1.5–4.5% silicon and 1.5–4.5 % boron, in a mixing ratio of 30:70–70:30, a cobalt-base alloy consisting essentially of 40–60% cobalt, 19–21% chromium, 1.5–4.5% silicon, 1.5–4.5% boron and a small amount of nickel and tungsten, in a mixing ratio of 30:70–70:30, and a mixture of zirconia or alumina, having a purity of more than 90%, with a nickel-aluminum alloy consisting essentially of 80–95% nickel and 20–5% aluminum, in a mixing ratio of 30:70–70:30; and then spraying a member selected from the group consisting of zirconia and alumina having a purity of more than 90% on said cermet layer by means of a spraying device using plasma jet or oxy-acetylene flame as a heat source to form a ceramic coating layer; all percentages being by weight.

11. A method as claimed in claim 10, in which said spraying is carried out by using plasma jet.

* * * * *